US009738478B2

(12) United States Patent
Makino

(10) Patent No.: US 9,738,478 B2
(45) Date of Patent: Aug. 22, 2017

(54) IMAGE FORMING APPARATUS

(71) Applicant: Brother Kogyo Kabushiki Kaisha, Nagoya-shi, Aichi-ken (JP)

(72) Inventor: Masato Makino, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/087,309

(22) Filed: Mar. 31, 2016

(65) Prior Publication Data

US 2016/0289037 A1 Oct. 6, 2016

(30) Foreign Application Priority Data

Mar. 31, 2015 (JP) ..... 2015-073393

(51) Int. Cl.
*B65H 29/12* (2006.01)
*B65H 43/08* (2006.01)
(Continued)

(52) U.S. Cl.
CPC ..... *B65H 29/125* (2013.01); *B65H 29/14* (2013.01); *B65H 29/58* (2013.01); *B65H 43/08* (2013.01); *B65H 85/00* (2013.01); *B65H 2301/33312* (2013.01); *B65H 2404/612* (2013.01); *B65H 2404/632* (2013.01); *B65H 2511/514* (2013.01);
(Continued)

(58) Field of Classification Search
CPC ..... B65H 15/00; B65H 85/00; B65H 29/125; B65H 29/58; B65H 29/14; B65H 43/08; B65H 2301/33312; B65H 2513/50; B65H 2513/51; B65H 2513/10; B65H 2513/106; B65H 2513/108; B65H 2513/11;
(Continued)

(56) References Cited

U.S. PATENT DOCUMENTS 8,711,406 B2 4/2014 Ito
8,837,121 B2 9/2014 Yamamoto
(Continued)

FOREIGN PATENT DOCUMENTS

JP 2002-370761 A 12/2002
JP 2006-143410 A 6/2006
(Continued)

*Primary Examiner* — David H Bollinger
(74) *Attorney, Agent, or Firm* — Banner & Witcoff, Ltd.

(57) ABSTRACT

An image forming apparatus, having a housing with an opening, an image forming unit, a path to guide a recording medium toward the opening, a reversible roller disposed in the path, and an intermediate reversible roller disposed between the image forming unit and the reversible roller, is provided. A rotating direction of the reversible roller is switchable between a first rotating direction and a second rotating direction opposite from the first rotating direction. A circumferential speed of the reversible roller is switchable between a predetermined circumferential speed and none. A rotating direction of the intermediate reversible roller is switchable between a third rotating direction and a fourth rotating direction opposite from the third rotating direction. The circumferential speed of the reversible roller in the first rotating direction is reduced to be lower than the predetermined circumferential speed while the intermediate reversible roller is rotating in the third rotating direction.

15 Claims, 7 Drawing Sheets

1

(51) Int. Cl.
*B65H 29/14* (2006.01)
*B65H 29/58* (2006.01)
*B65H 85/00* (2006.01)

(52) U.S. Cl.
CPC ..... *B65H 2513/11* (2013.01); *B65H 2801/12* (2013.01)

(58) Field of Classification Search
CPC ..... B65H 2404/612; B65H 2511/514; B65H 2404/632; B65H 2801/12
USPC ..... 271/3.14, 301, 65, 186
See application file for complete search history.

(56) References Cited

U.S. PATENT DOCUMENTS

2006/0255529 A1 11/2006 Tanjo et al.
2011/0205692 A1 8/2011 Yamamoto
2011/0211223 A1 9/2011 Ito
2011/0268484 A1* 11/2011 Aoi ..... B65H 85/00 399/397
2012/0051818 A1* 3/2012 Yamaguchi ..... B65H 3/06 399/397
2012/0104675 A1* 5/2012 Iino ..... B65H 5/062 271/3.2
2012/0104677 A1* 5/2012 Iino ..... B65H 1/266 271/3.19
2012/0104678 A1* 5/2012 Iino ..... B41J 3/60 271/3.19
2013/0026705 A1* 1/2013 Masuda ..... G03G 15/234 271/225
2013/0043638 A1* 2/2013 Iino ..... B65H 85/00 271/3.14
2013/0082439 A1* 4/2013 Inoue ..... B65H 85/00 271/225
2014/0117617 A1* 5/2014 Inoue ..... B65H 7/20 271/265.01
2014/0241779 A1* 8/2014 Akatsuka ..... G03G 15/6561 399/393
2014/0291923 A1* 10/2014 Hashimoto ..... B65H 85/00 271/225
2015/0069698 A1* 3/2015 Sugiura ..... B41J 3/60 271/254

FOREIGN PATENT DOCUMENTS

JP 2006-301469 A 11/2006
JP 2008-162744 A 7/2008
JP 2010-020353 A 1/2010
JP 2011-174492 A 9/2011
JP 2011-180203 A 9/2011
JP 2014-115573 A 6/2014
JP 2015-030556 A 2/2015

* cited by examiner

IMAGE FORMING APPARATUS

CROSS REFERENCE TO RELATED APPLICATION

This application claims priority from Japanese Patent Application No. 2015-073393 filed on Mar. 31, 2015, the entire subject matter of which is incorporated herein by reference.

BACKGROUND

Technical Field

An aspect of the present invention relates to an electrophotographic image forming apparatus.

Related Art

An image forming apparatus capable of forming electrophotographic images on either side of a recording medium is known. The image forming apparatus may form images on both sides of a recording sheet by, for example, forming an image on a first side of the recording sheet in an image forming unit and conveying and inverting the recording sheet to reenter the image forming unit once again to form another image on a second side of the recording sheet.

The image forming apparatus may have a pair of exit rollers, a pair of reversible rollers, and a duplex path. The exit rollers may convey the recording sheet conveyed through a fixing unit to discharge the recording sheet outside. The reversible rollers may convey the recording sheet conveyed through the fixing unit to the image forming unit through the duplex path.

SUMMARY

When images are to be formed on both sides of the recording sheet in this image forming apparatus, after forming the first image on the first side of the recording sheet, the recording sheet may be conveyed through the fixing unit and drawn into a lead-in path by the reversible rollers so that the recording sheet may be reversed and guided to the duplex path.

When the recording sheet is drawn into the lead-in path, a part of the recording sheet may be exposed outside above a sheet-outlet tray, on which previously discharged recording sheets may be stacked. The exposed part of the recording sheet may collide with the recording sheets stacked on the sheet-outlet tray, or with another recording sheet, which is being discharged by the exit rollers. In other words, the recording sheet being inverted may be interfered with by neighboring objects in an area around the sheet-outlet tray.

The present disclosure is advantageous in that an image forming apparatus, in which a recording medium conveyed through an image forming unit may be inverted smoothly, is provided.

According to an aspect of the present disclosure, an image forming apparatus, having a housing formed to have a first opening; an image forming unit; a first path formed to guide a recording medium conveyed through the image forming unit toward the first opening; a reversible roller disposed in the first path, and an intermediate reversible roller disposed between the image forming unit and the reversible roller in the first path, is provided. A rotating direction of the reversible roller is switchable between a first rotating direction, in which the recording medium is conveyed toward the first opening, and a second rotating direction opposite from the first rotating direction. A circumferential speed of the reversible roller is switchable between a predetermined circumferential speed and none. A rotating direction of the intermediate reversible roller is switchable between a third rotating direction, in which the recording medium is conveyed from the image forming unit toward the reversible roller, and a fourth rotating direction opposite from the third rotating direction. The circumferential speed of the reversible roller in the first rotating direction is reduced to be lower than the predetermined circumferential speed while the intermediate reversible roller is rotating in the third rotating direction.

BRIEF DESCRIPTION OF THE ACCOMPANYING DRAWINGS

DETAILED DESCRIPTION

Figure 1:
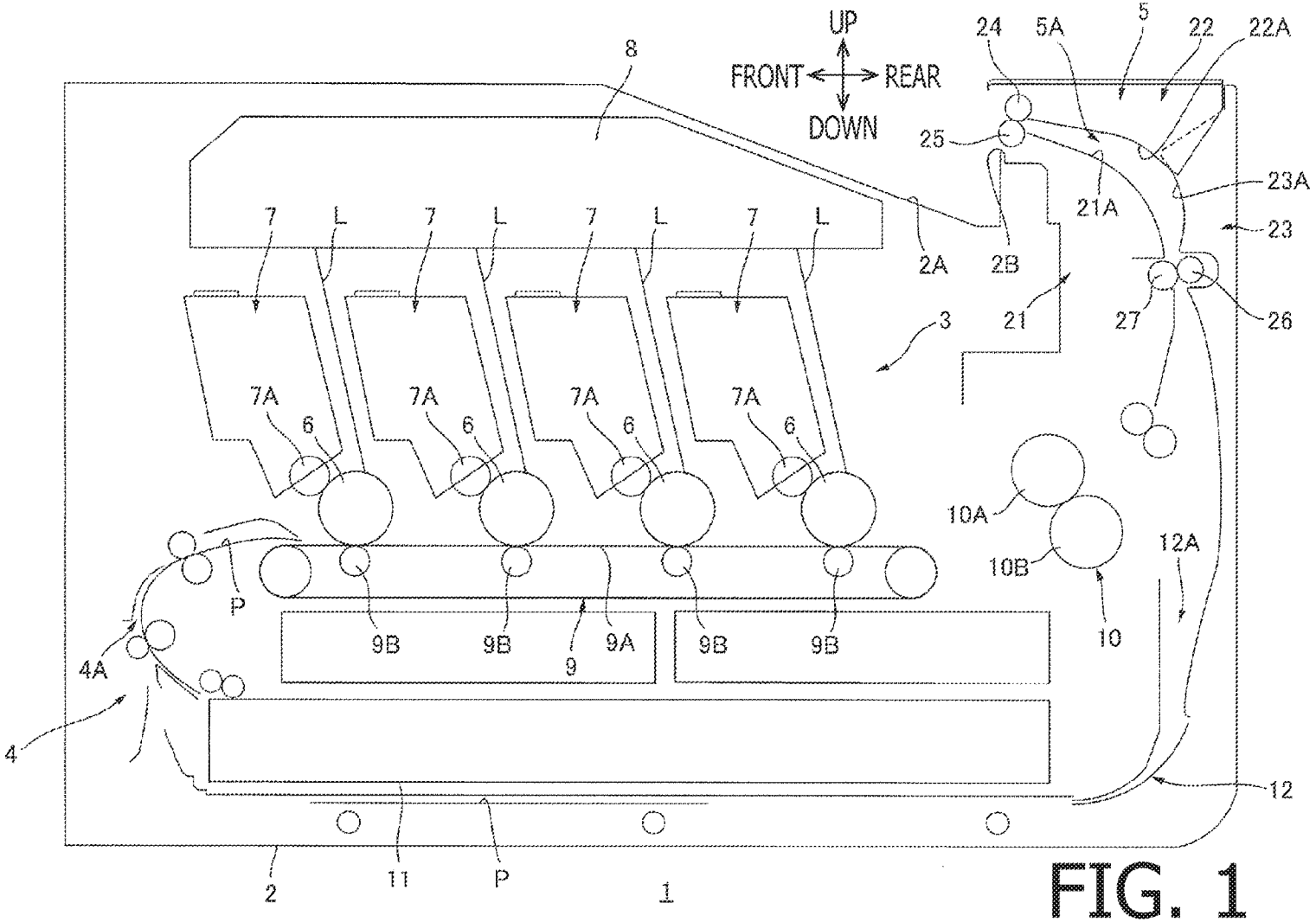
FIG. 1 is a cross-sectional view of an image forming apparatus according to a first exemplary embodiment of the present disclosure.

Hereinafter, exemplary configurations of image forming apparatuses 1, 40 according to embodiments of the present disclosure will be described with reference to the accompanying drawings. In the following description, orientations concerning the image forming apparatuses 1, 40 will be referred to in accordance with directions indicated by arrows in each drawing. A front-to-rear or rear-to-front direction may be referred to as a front-rear direction, a right-to-left or left-to-right direction may be referred to as a widthwise direction, and an up-to-down or down-to-up direction may be referred to as a vertical direction.

In the following description, identical parts or items may be referred to by a same reference sign, and redundant explanation of those will be omitted. A quantity of each element, part, or item is, unless specified otherwise, at least one. Embodiment of the present disclosure may not necessarily be limited to the exemplary configurations described below.

1. First Embodiment 1-1. Overall Configuration of the Image Forming Apparatus

The image forming apparatus 1 being a laser printer according to the first embodiment has a housing 2 which is formed to have a sheet exit 2B, an image forming unit 3, a feeder unit 4 including a feeding path 4A, and a sheet-exit unit 5 including a sheet-exit path 5A.

The housing 2 forms an exterior covering of the image forming apparatus 1 and has an approximate shape of a box. The housing 2 accommodates the image forming unit 3, the feeder unit 4, and the sheet-exit unit 5 therein. The housing 2 includes a sheet-outlet tray 2A.

The sheet-outlet tray 2A is arranged on an upper face of the housing 2 in an upper position with respect to the image forming unit 3. The sheet-outlet tray 2A is formed to dent downward on the upper face of the housing 2.

The sheet exit 2B is arranged in an upper-rearward position with respect to the sheet-outlet tray 2A to open in the front-rear direction, which is an orthogonal direction to the vertical direction. In other words, the sheet exit 2B orients the sheet outlet 2A along the front-rear direction. The sheet exit 2B connects space inside the housing 2 and atmosphere outside the housing 2 with each other.

The image forming unit 3 is disposed in an approximately central area in the image forming apparatus 1 and includes a plurality of (e.g., four) photosensitive drums 6, a plurality of (e.g., four) developer devices 7, an exposure device, a transfer device 9, and a fixing device 10.

The plurality of photosensitive drums 6 are arranged to be spaced apart from one another along the front-rear direction. Each photosensitive drum 6 has a cylindrical shape, which axially extends in the widthwise direction.

The plurality of developer devices 7 are arranged to be spaced apart from one another along the front-rear direction. Each developer devices 7 is disposed in an upper-frontward position with respect to each of the photosensitive drums 6 and contains a toner. Each developer device 7 includes a developer roller 7A.

The developer roller 7A is disposed in a lower-rearward position in the developer device 7. The developer roller 7A is arranged to contact one of the photosensitive drums 6 and supplies the toner to the contacting photosensitive drum 6.

The exposure device 8 is disposed in an upper position with respect to the developer devices 7. The exposure device 8 may emit laser beams L according to image data, which corresponds to an image to be formed. The laser beams L emitted from the exposure device 8 are transmitted through rearward areas with respect to the developer devices 7 to reach surfaces of the photosensitive drums 6.

The transfer device 9 is disposed in a lower position with respect to the photosensitive drums 6. The transfer device 9 is laid along the front-rear direction. The transfer device 9 includes a belt 9A and a plurality of (e.g., four) transfer rollers 9B.

The belt 9A is an endless belt and is arranged to contact the photosensitive drums 6 at an upper surface thereof. The belt 9A circulates in one direction so that the upper surface should move, for example, rearward.

The plurality of transfer rollers 9B are arranged on an inner side of the belt 9A to be spaced apart from one another along the front-rear direction. The transfer rollers 9B are disposed in lower positions with respect to the photosensitive drums 6 to nip the belt 9A in there-between.

The fixing device 10 is disposed in a rearward position with respect to the transfer device 9. The fixing device 10 includes a heat roller 10A and a pressure roller 10B arranged to contact each other.

The feeder unit 4 is disposed in a lower position in the image forming apparatus 1. The feeder unit 4 may convey a sheet P to the image forming unit 3 and includes a feeder tray 11.

A feeding path 4A is formed to extend upper-frontward from an upper-frontward position with respect to the feeder tray 11 to curve rearward to reach a frontward position with respect to one of the photosensitive drums 6 which is in a most frontward position among the plurality of photosensitive drums 6.

The feeder tray 11 is disposed in a lower position with respect to the transfer device 9. The feeder tray 11 may store one or more sheets P therein.

The sheet-exit unit 5 is disposed in an upper-rearward position in the image forming apparatus 1. The sheet-exit unit 5 may discharge the sheet P conveyed through the fixing device 10 to rest on the sheet exit tray 2A.

A sheet-exit path 5A is formed to extend upward from an upper-rearward position with respect to the fixing device 10 and curve frontward to be continued to the sheet exit 2B. In other words, the sheet-exit path 5A extends upward from the fixing device 10 and curves toward the sheet-outlet tray 2A. Thus, the sheet-exit path 5A may guide the sheet P exiting the fixing device 10 to the sheet exit 2B.

When the image forming apparatus 1 starts forming an image, the exposure device 8 emits the laser beams L at selected areas on the surfaces of the photosensitive drums 6 so that the selected areas are exposed to the laser beams L. Thereby, electrostatic latent images corresponding to the image data are formed on the surfaces of the photosensitive drums 60.

Thereafter, the toners are supplied to the electrostatic latent images on the surfaces of the photosensitive drums 6 by the developer rollers 7A. Thereby, toner images are formed and carried on the surfaces of the photosensitive drums 6.

Thereafter, the sheets P in the feeder tray 11 are conveyed one-by-one at predetermined timings to proceed the feeding path 4A to be supplied to a position between the photosensitive drum 6 on the front and the belt 9A. Each sheet P is conveyed rearward by the belt 9A to contact the photosensitive drums 6 sequentially. The toner images formed on the surfaces of the photosensitive drums 6 are transferred sequentially to the sheet P when the sheet P contacts the photosensitive drums 6.

The sheet P is conveyed through a position between the heat roller 10A and the pressure roller 10B, and pressure and heat from the heat roller 10A and the pressure roller 10B are applied to the sheet P. Thus, the toner images transferred onto the sheet P are fused to be fixed thereon by the fixing device 10.

Thereafter, the sheet P is conveyed through the sheet-exit path 5A and the sheet exit 2B to be discharged out of the housing 2 and placed on the sheet-outlet tray 2A.

1-2. Duplex Path

The image forming apparatus 1 includes a duplex conveyer 12 having a duplex path 12. The duplex conveyer 12 is disposed in a lower position in the image forming apparatus 1. The duplex conveyer 12 may convey the sheet P conveyed through the fixing unit 10 to a midst position in the feeding path 4A.

The duplex path 12A starting from a lower-rearward position with respect to the fixing device 10 extends downward, curves frontward through a lower area with respect to the feeder tray 11, and curves upward to be connected to the feeding path 4A at the midst position.

1-3. Detailed Description of the Sheet-Exit Unit

Figure 2:
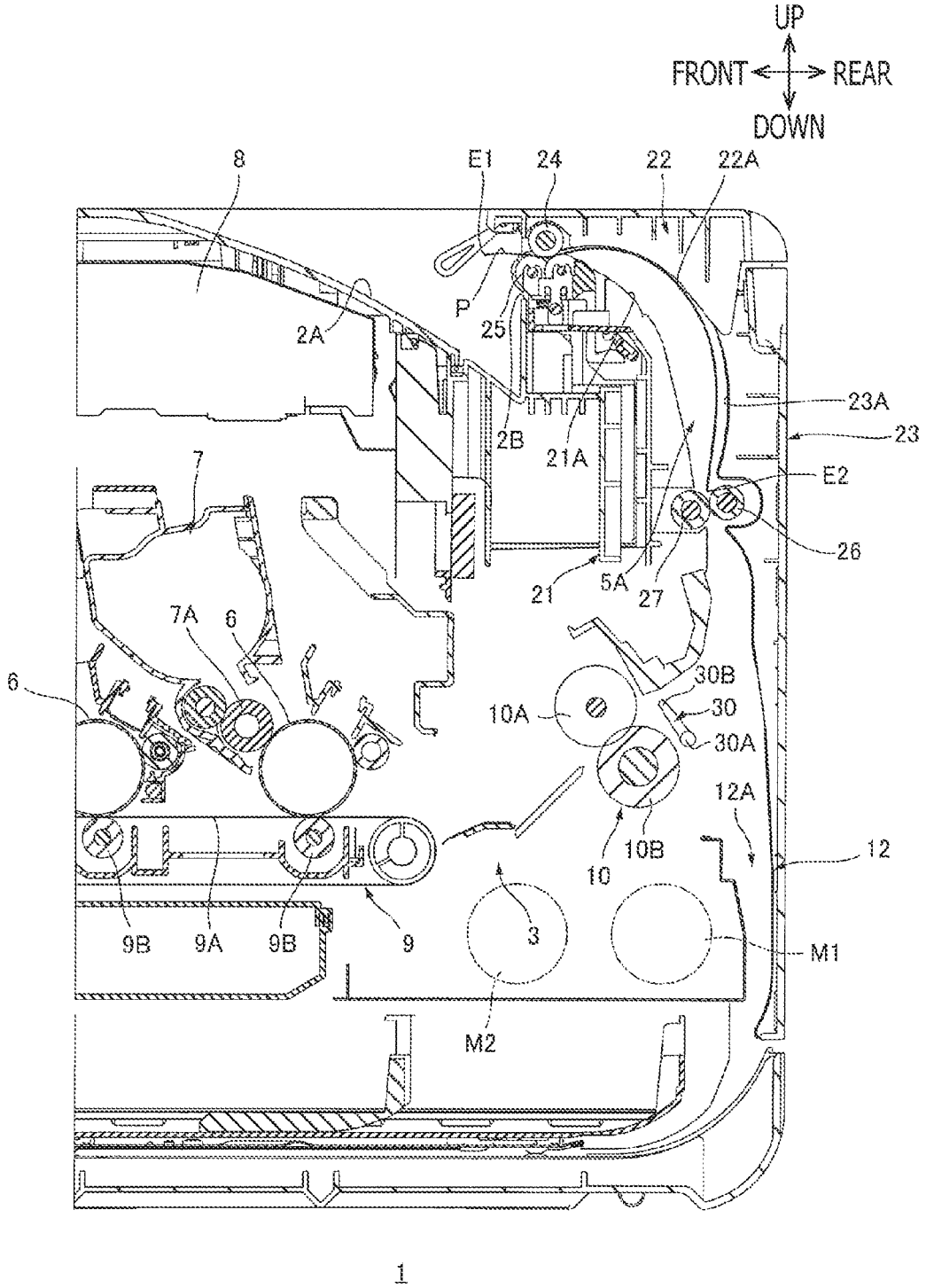
FIG. 2 is a cross-sectional view of a sheet-exit unit in the image forming apparatus according to the first exemplary embodiment of the present disclosure.

As shown in FIG. 2, the sheet-exit unit 5 is disposed in a rearward position with respect to the sheet-outlet tray 2A. The sheet-exit unit 5 includes a first frame 21, a second frame 22, a rear cover 23, and a sensor 30.

The first frame 21 is disposed in an upper position with respect to the fixing device 10. The first frame 21 has a first guiding rib 21A, an opposing roller 25, a conveyer roller 26, and an opposing roller 27.

The first guiding rib 21A is formed on a rearward face of the first frame 21 to protrude rearward from the rear face of the first frame 21. The first guiding rib 21A is formed to extend in the vertical direction and curve upper-frontward in an upper part thereof.

The opposing roller 25 is attached to an upper-front part of the first frame 21. The opposing roller 25 may be rotated to accompany rotation of an exit roller 24.

The conveyer roller 26 is disposed on a frontward face of the rear cover 23. The conveyer roller 26 is disposed in a midst position in the sheet-exit path 5A between the fixing device 10 and the exit roller 24. The conveyer roller 26 is driven by a driving force from a drive source M1 to rotate about a rotation axis, which extends in the widthwise direction. In other words, the widthwise direction coincides with the rotation axis of the conveyer roller 26. Rotation of the conveyer roller 26 is switchable between two (2) rotating directions: a direction to convey the sheet P upward toward the exit roller 24, and an opposite direction to convey the sheet P downward. The rotating direction for the conveyer roller 26 to convey the sheet P upward will be herein referred to as a third rotating direction being a normal direction, and the rotating direction for the conveyer roller 26 to convey the sheet P downward will be herein referred to as a fourth rotating direction being a reverse direction. A first rotating direction and a second rotating direction will be described below. The conveyer roller 26 may rotate in the third rotating direction to convey the sheet P toward the exit roller 24 at a third predetermined circumferential speed and in the fourth rotating direction at a fourth predetermined circumferential speed. A first predetermined circumferential speed and a second predetermined circumferential speed are described below.

The opposing roller 27 is disposed in a frontward position with respect to the conveyer roller 26 to oppose to the conveyer roller 26. The opposing roller 27 is attached to the rearward face of the first frame 21 and is arranged to contact the conveyer roller 26. The opposing roller 27 may be rotated to accompany rotation of the conveyer roller 26.

The second frame 22 is disposed in an upper position with respect to the first frame 21 to be spaced apart from the first frame 21. Therefore, the second frame 21 is spaced apart in the vertical direction farther than the first frame 21 from the fixing device 10. The second frame 22 includes a plate stretching in the front-rear direction. The second frame 22 in conjunction with the first frame 21 forms an upper part of the sheet-exit path 5A. The second frame 22 includes a second guiding rib 22A and the exit roller 24.

The second guiding rib 22A is formed on a lower face of the second frame 22 to protrude downward and extend in the front-rear direction. The second guiding rib 22A is formed to curve upward to form convexity in a central range thereof with regard to the front-rear direction. A curvature radius of the curve of the second guiding rib 22A is, in a view along the widthwise direction, smaller than a curvature radius of the curve in the first guiding rib 21A.

The exit roller 24 is attached to a frontend part of the second frame 22 in an upper position with respect to the opposing roller 25. In other words, the exit roller 24 is disposed at an upper-front position in the exit path 5A. The exit roller 24 is disposed on an opposite side in the front-rear direction from the sheet-outlet tray 2A across the sheet exit 2B. The exit roller 24 is arranged to contact the opposing roller 25 and is driven to rotate by a driving force from a drive source M2. Rotation of the exit roller 24 is switchable between two (2) rotating directions: a direction to convey the sheet P frontward toward the sheet exit 2B, and an opposite direction to convey the sheet P rearward. The rotating direction for the exit roller 24 to convey the sheet P frontward will be herein referred to as the first direction being the normal direction, and the rotating direction for the exit roller 24 to convey the sheet P rearward will be herein referred to as the second rotating direction being the reverse direction. The exit roller 24 may rotate in the first rotating direction to convey the sheet P toward the sheet exit 2B at a first predetermined circumferential speed and in the second rotating direction at a second circumferential speed. The first predetermined circumferential speed for the exit roller 24 and the third predetermined circumferential speed for the conveyer roller 26 are substantially equal, and the second predetermined circumferential speed for the exit roller 24 and the fourth predetermined circumferential speed for the conveyer roller 26 are substantially equal.

The rear cover 23 is disposed in a lower position with respect to a rear end part of the second frame 22, in a rearward position with respect to the first frame 21 to be spaced apart from the first frame 21. Therefore, the rear cover 23 is spaced apart in the front-rear direction farther than the first frame 21 from the fixing device 10. The rear cover 23 in conjunction with the first frame 21 forms a lower part of the exit path 5A. The rear cover 23 includes a plate extending in the vertical direction. The rear cover 23 includes a third guiding rib 23A.

The third guiding rib 23A is formed on a frontward face of the rear cover 23 to protrude frontward. The third guiding rib 23A extends in the vertical direction and is formed to curve rearward in a vertically central range thereof. The third rib 23A may guide the sheet P toward the sheet exit 2B in conjunction with the second guiding rib 22A. A curvature radius of the curve in the third guiding rib 23A is, in a view along the widthwise direction, smaller than the curvature radius of the curve in the first guiding rib 21A.

A sensor 30 is disposed in an upper-rearward position with respect to the pressure roller 10B. In other words, the sensor 30 is disposed between the fixing device 10 and the conveyer roller 26 in the sheet-exit path 5A. The sensor 30 includes a rotation shaft 30A at a lower end of the sensor 30 and a contact part 30B extending upper-frontward from the rotation shaft 30A. The sensor 30 is pivotable between a non-detecting position (see FIG. 2), in which a tip end of the contact part 30B is at an upper-rearward position with respect to a mutually contacting position between the heat roller 10A and the pressure roller 10B, and a detecting position (see FIG. 4), in which the tip end of the contact part 30B is retracted rearward from the non-contacting position.

1-4. Sheet Conveyance to the Duplex Path

A flow of behaviors to convey the sheet P to the duplex path 12A will be described below with reference to FIGS. 2 and 3.

The sheet P with an image printed on one side, e.g., a first side, thereof is conveyed through the contacting position between the heat roller 10A and the pressure roller 10B. In the following description, with regard to a direction for the sheet P to be conveyed through the contacting position between the heat roller 10A and the pressure roller 10B, a downstream end area and an upstream end area in the sheet P will be referred to as a first end E1 and a second end E2, respectively. The conveyer roller 26 and the exit roller 24 may start rotating at the first and third predetermined circumferential speed in the normal direction at a same timing as start of rotation of the heat roller 10A.

After exiting the contacting position, at timing t1, the first end E1 of the sheet P contacts the contact part 30B of the sensor 30, and the sensor 30 is pivoted by the sheet P from the non-detecting position to the detecting position. Thereby, the sensor 30 may detect the first end E1 of the sheet P.

The first end E1 of the sheet P enters a nipping position between the conveyer roller 26 and the opposing roller 27, and thereafter the sheet P is conveyed upward by the conveyer roller 26 rotating in the normal direction and accompanying rotation of the opposing roller 27.

Further, the first end E1 of the sheet P enters the position between the exit roller 24 and the opposing roller 25, and the sheet P is conveyed frontward by the exit roller 24 rotating in the normal direction and accompanying rotation of the opposing roller 25.

After timing t1, at timing t2, the exit roller 24 is slowed to a lower circumferential speed than the first predetermined circumferential speed. For example, the circumferential speed of the exit roller 24 may be reduced to none so that the exit roller 24 stops rotating. In the present embodiment, the exit roller 24 is stopped. The timing t2 to stop the rotation of the exit roller 24 may be determined based on timing t1, at which the sensor 30 is moved to the detecting position. More specifically, timing t2 may be at a point, when a time period T1 elapses since timing t1.

At timing t2, the exit roller 24 stops rotating with the first end E1 of the sheet P nipped between the exit roller 24 and the opposing roller 25. The first end E1 of the sheet P may be exposed outside through the sheet exit 2B. Alternately, at timing t2, the exit roller 24 may be stop rotating, before the first end E1 of the sheet P should be conveyed through the position between the exit roller 24 and the opposing roller 25, i.e., without conveying the first end E1 beyond the position between the exit roller 24 and the opposing roller 25. The first end E1 of the sheet P may reach the exit roller 24 but should stay inside the sheet exit 2B without being exposed.

Thereafter, with the exit roller 24 being stopped, the conveyer roller 26 is rotated in at the third predetermined circumferential speed in the normal direction. In other words, the exit roller 24 stops rotating while the conveyer roller 26 keeps rotating in the normal direction. Therefore, the first end E1 is maintained nipped by the exit roller 24 and the opposing roller 25. Meanwhile, the second end E2 of the sheet P is conveyed upward by the normal rotation of the conveyer roller 26 and the accompanying rotation of the opposing roller 27. Therefore, the sheet P relaxes to bow rearward and accommodated in the exit path 5A.

After timing t2, the second end E2 of the sheet P reaches and exits the nipping position between the conveyer roller 26 and the opposing roller 27. While the first end E1 of the sheet P is nipped by the exit roller 24 and the opposing roller 25, the sheet P may hang down in the exit path 5A, and the second end E2 of the sheet P exiting the nipping position between the conveyer roller 26 and the opposing roller 27 may float around the nipping position due to the effect of gravity. At timing t3, with the second end E2 of the sheet P conveyed through and floating around the nipping position between the conveyer roller 26 and the opposing roller 27, the conveyer roller 26 is rotated in the reverse direction at the fourth predetermined circumferential speed. The second end E2 of the sheet P may be caught by the reverse rotation of the conveyer roller 26 to reenter the nipping position between the conveyer roller 26 and the opposing roller 27 to be conveyed downward. The timing t3 to start the reverse rotation of the conveyer roller 26 may be determined based on timing t1, at which the sensor 30 is moved to the detecting position. In other words, timing t3 may be at a point, when a time period T2 elapses since timing t1. Thus, the second end E2 of the sheet P is nipped by the conveyer roller 26 and the opposing roller 27.

After timing t3, at timing t4, the exit roller 24 starts rotating in the reverse direction at the second predetermined circumferential speed. The timing t4 to start the reverse rotation of the exit roller 24 may be determined based on timing t2, at which the exit roller 24 stopped rotating. In other words, timing t4 may be at a point, when a time period T3 elapses since timing t2.

In this flow, the conveyer roller 26 keeps rotating in the reverse direction while the exit roller 24 is stopped until timing t4; therefore, the sheet P is pulled downward by the conveyer roller 26, and by timing t4, the relaxed curve of the sheet P is removed.

When the exit roller 24 starts rotating in the reverse direction at timing t4, the sheet P is conveyed downward by the reverse rotation of the conveyer roller 26 and the reverse rotation of the exit roller 24.

Thereafter, the sheet P is conveyed by the reverse rotation of the conveyer roller 26 to pass by the fixing device 10 downward and, with the second end E2 now being a leading end, enters the duplex path 12A.

The sheet P entering the duplex path 12A is conveyed through the duplex path 12A to the midst position in the feeding path 4A (see FIG. 1).

1-5. Effects by the First Exemplary Configuration

Figure 3:
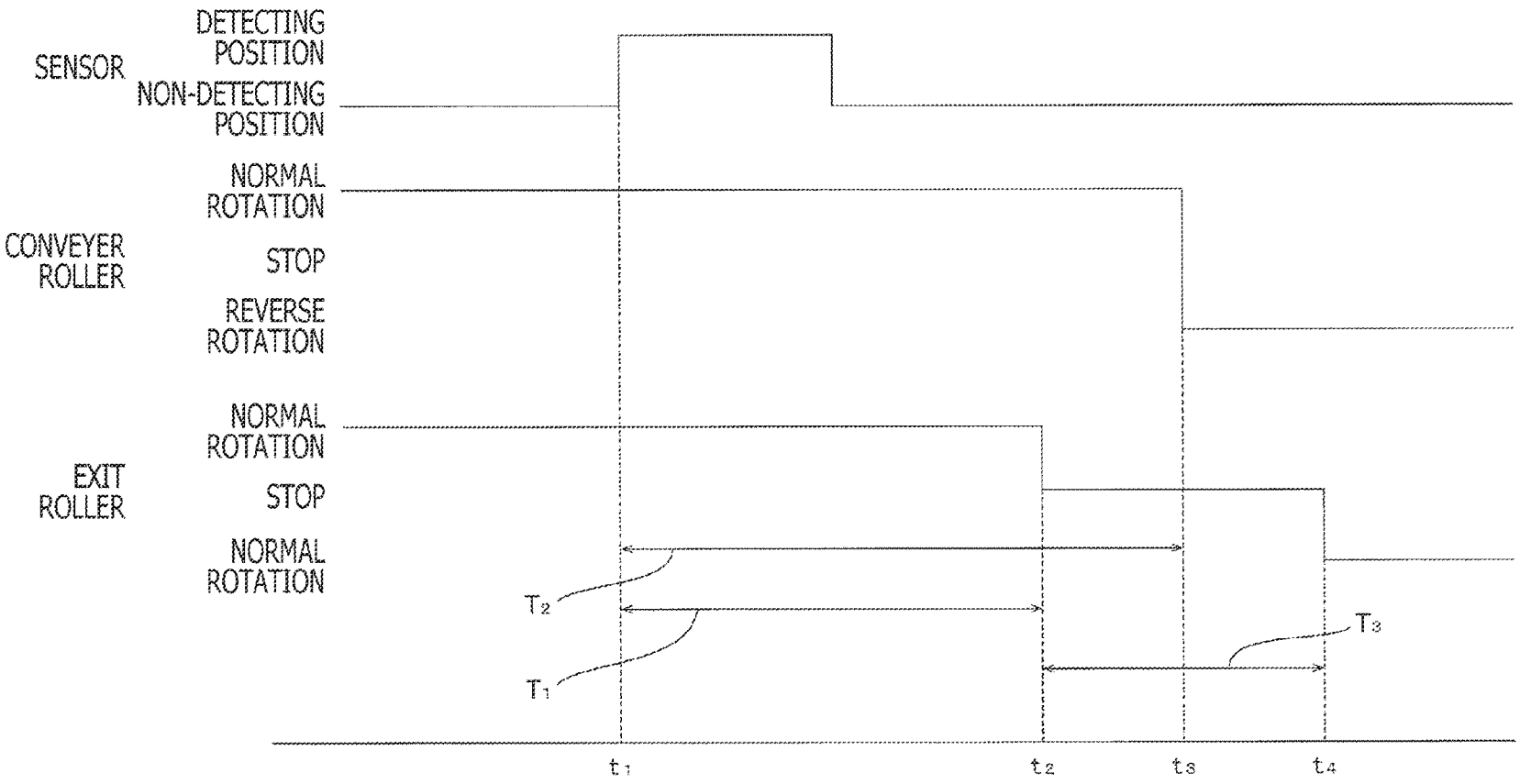
FIG. 3 is a timing chart to illustrate behaviors in the sheet-exit unit in the image forming apparatus according to the first exemplary embodiment of the present disclosure.

According to the image forming apparatus 1 described above, when the conveyer roller 26 rotates in the normal direction, and while the sheet P is drawn in the sheet-exit path 5A, at timing t2, as shown in FIG. 3, the exit roller 24 stops rotating. In this regard, as shown in FIG. 2, the sheet P may be restrained from being exposed through the sheet exit 2B.

Therefore, the sheet P drawn in the exit path 5A may be restrained from contacting or colliding with objects neighboring around the sheet exit 2B. Accordingly, at timing t3, when the conveyer roller 26 is rotated in the reverse direction, and at timing t4, when the exit roller 24 is rotated in the reverse direction, the sheet P may be reversed smoothly.

According to the image forming apparatus 1 described above, further, the exit roller 24 starts rotating in the reverse direction after the sheet P exits the conveyer roller 26. Therefore, while the conveyer roller 26 rotates in the normal direction, the sheet P having been heated by the fixing device 10 may be contacted entirely by the conveyer roller 26. Accordingly, the sheet P having been heated by the fixing device 10 may be cooled by the conveyer roller 26 so that the image on the sheet P may be fixed thereat more quickly and stably. In this regard, at timing t3, the conveyer roller 26 may be switched to rotate in the reverse direction when the second end E2 of the sheet P reaches the nipping position between the conveyer roller 26 and the opposing roller 27, before the second end E2 of the sheet P completely exits the nipping position. In this configuration, a small part of the sheet P on the downstream side with respect to the conveyer roller 26 may not be conveyed beyond the conveyer roller 26 to be cooled by the conveyer roller 26; however, the sheet P may be maintained held securely at the second end E2 by the conveyer roller 26 and the opposing roller 27 to be conveyed downward without skewing in the duplex path 12A.

According to the image forming apparatus 1 described above, further, after the conveyer roller 26 starts rotating in the reverse direction at timing t3, at timing t4, as shown in FIG. 3, the exit roller 24 starts the reverse rotation. Therefore, after the conveyer roller 26 starts the reverse rotation, and until the exit roller 24 starts the reverse rotation, the conveyer roller 26 conveys the second end E2 of the sheet P while the first end E1 of the sheet P 24 is held by the exit roller 24. Accordingly, the sheet P may be pulled downward by the conveyer roller 26, and the relaxed curve of the sheet P may be removed.

According to the image forming apparatus 1 described above, further, as shown in FIG. 2, the sheet-exit path 5A extends upward from the image forming unit 3 and thereafter curves frontward toward the sheet-outlet tray 2A. Therefore, the sheet P may bow along the sheet-exit path 5A while the sheet P is drawn into the range between the exit roller 24 and the conveyer roller 26. Accordingly, when the sheet P is drawn into the range between the exit roller 24 and the conveyer roller 26, unintended deformation of the sheet P in an undesirable direction may be prevented. Thus, the sheet P may be reversed more stably and smoothly.

According to the image forming apparatus 1 described above, further, as shown in FIG. 2, the curvature radius of the first guiding rib 21A in the view along the widthwise direction is smaller than the curvature radius of the second guiding rib 22A or the third guiding rib 23A in the view along the widthwise direction. In other words, the third guiding rib 23A, which is at the position farther than the first guiding rib 21A from the image forming unit 3, is curved more largely or moderately than the first guiding rib 21A. Accordingly, a substantial amount of gap may be reserved between the first guiding rib 21A and the third guiding rib 23A at the curve of the third rib 23A. Thus, the sheet P may be allowed to relax in the gap between the first guiding rib 21A and the third guiding rib 23A. In this regard, the sheet P may be drawn into the range between the exit roller 24 and the conveyer roller 26 easily.

According to the image forming apparatus 1 described above, further, as shown in FIG. 3, the exit roller 24 stops rotating at timing t2, which is later than timing t1, when the sensor 30 detects the first end E1 of the sheet P, for the time period T1. Thereafter, the conveyer roller 26 starts rotating in the reverse direction at timing t3, which is later than timing t1 for the time period T2. Further, the exit roller 24 starts rotating in the reverse direction at timing t4, which is later than timing t2, when the exit roller 24 stopped rotating, for the time period T3. Thus, with the simple configuration based on timing t1, at which the sensor 30 detects the first end E1 of the sheet P, the behaviors of the exit roller 24 and the conveyer roller 26 may be easily controlled.

2. Second Embodiment

The image forming apparatus 40 according to a second embodiment of the present disclosure will be described below. In the following description, parts or items that are identical to those described in the first embodiment will be referred to by same reference signs, and redundant explanation of those will be herein omitted.

2-1. Overall Configuration of the Image Forming Apparatus

In the image forming apparatus 1 in the first embodiment, the sheet P is inverted through the exit path 5A in the sheet-exit unit 5. On the other hand, the image forming apparatus 40 in the second embodiment has a sheet-exit unit 41, in which a sheet-exit path 41A and a reversing path 41B are separately formed. The sheet-exit unit 41 may invert a sheet P through the reversing path 41B while another sheet P is discharged through the sheet-exit path 41A.

2-2. Detailed Configuration of the Image Forming Apparatus

2-2-1. Housing

Figure 4:
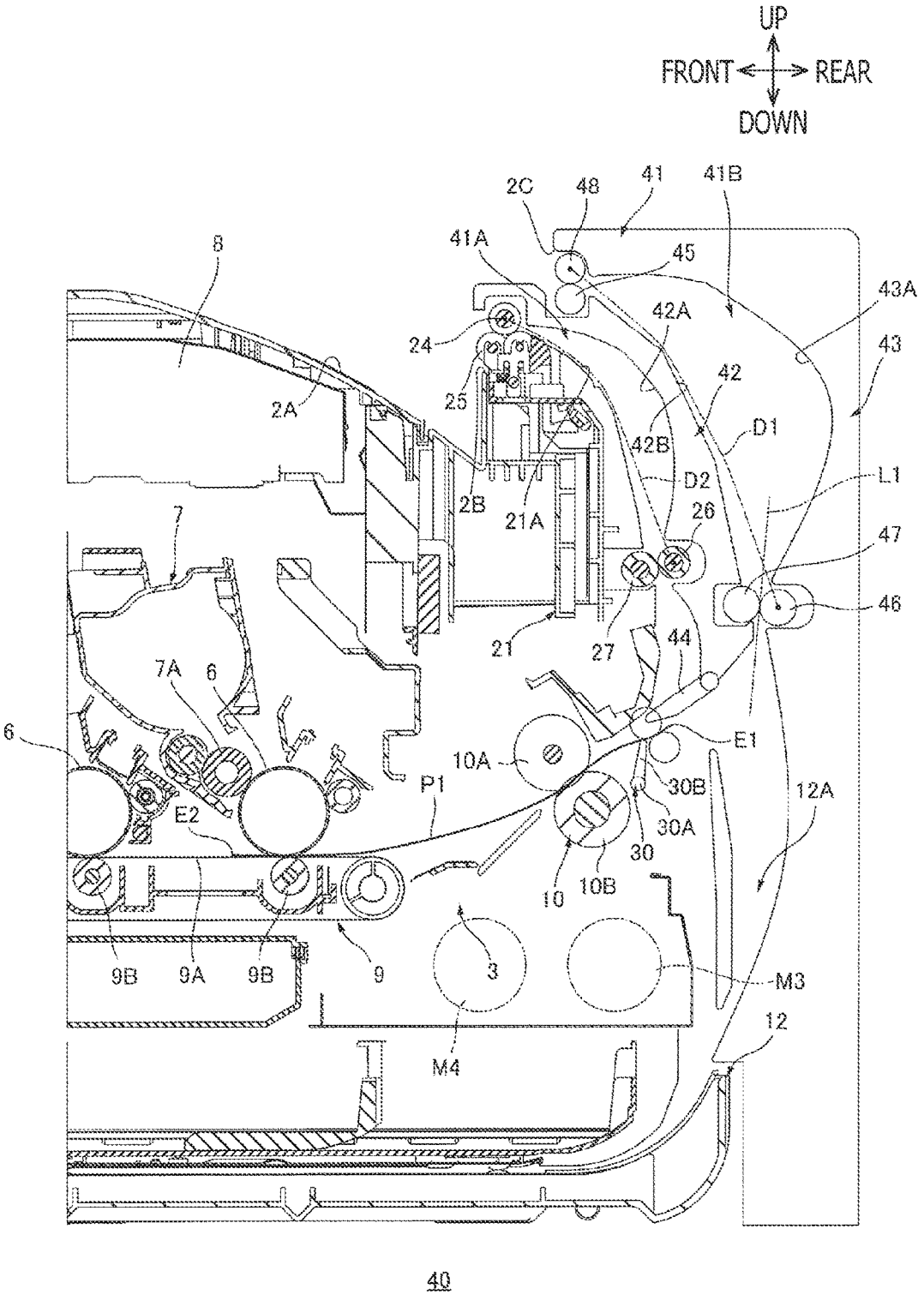
FIG. 4 is a cross-sectional view of a sheet-exit unit in an image forming apparatus, with a flap in a sheet-exit unit being in a first guiding position and a first sheet contacting a sensor, according to a second exemplary embodiment of the present disclosure.

As shown in FIG. 4, the housing 2 is formed to have an opening 2C in an upper-rearward position with respect to the sheet exit 2B to open in the front-rear direction. In other words, the opening 2C orients the sheet outlet 2A along the front-rear direction. The opening 2C connects the space inside the housing 2 and atmosphere outside the housing 2 with each other.

2-2-2. Sheet Exit Unit

The sheet-exit path 41A is, similarly to the sheet-exit path 5A in the first embodiment, formed to extend from an upper-rearward position with respect to the fixing device 10 and curve frontward to be connected to the sheet exit 2B. Thus, the sheet-exit path 41A may guide the sheet P exiting the fixing device 10 to the sheet exit 2B.

The reversing path 41B is formed in a rearward position with respect to the sheet-exit path 41A. Therefore, the reversing path 41B and the sheet-exit path 41A are arranged alongside each other in the front-rear direction. The reversing path 41B is formed to extend upward from a rearward position with respect to the fixing device 10 and curve frontward to be continuous with the sheet exit 2B. In other words, the reversing path 41B extends upward from the fixing device 10 and curves toward the sheet-outlet tray 2A. Thus, the reversing path 41A may guide the sheet P conveyed through the fixing device 10 to the opening 2C.

The sheet-exit unit 41 in the image forming apparatus 40 in the second embodiment may not include the second frame 22 or the rear cover 23 but includes a second frame 42 and a rear cover 43.

The second frame 42 is disposed in a rearward position with respect to the first frame 21 to be spaced apart from the first frame 21. The second frame 42 extends in the vertical direction and includes a plate, of which upper part is curved frontward. The second frame 42 in conjunction with the first frame 21 forms the sheet-exit path 41A. The second frame 42 has a second guiding rib 42A, a third guiding rib 42B, a flap 44, an opposing roller 45, a first intermediate reversible roller 46, and a second intermediate reversible roller 47.

The second guiding rib 42A is formed on a frontward face of the second frame 42 to protrude frontward. The second guiding rib 42A extends in the vertical direction. The second guiding rib 42A is formed to curve frontward at an upper part thereof.

The third guiding rib 42B is formed on a rearward face of the second frame 42 to protrude rearward. The third guiding rib 42B extends in the vertical direction. The third guiding rib 42B includes an upper part which curves frontward.

The flap 44 is attached to a lower end of the second frame 42. The flap 44 include a plate and is pivotable about an upper end thereof between a first guiding position (see FIG. 4), in which the flap 44 closes the sheet-exit path 14A and opens the reversing path 41B, and a second guiding position (see FIG. 5), in which the flap 44 opens the sheet-exit path 41A and closes the reversible path 41B. The flap 44 may switch the paths for the sheet P to be conveyed.

The opposing roller 45 is attached to an upper-front part of the second frame 42, in a rearward position with respect to the exit roller 24. The opposing roller 45 may be rotated to accompany rotation of a reversible roller 48, which will be described later.

The first intermediate reversible roller 46 is disposed on a frontward face of the rear cover 43 in a rearward position with respect to a lower end of the second frame 42. The first intermediate reversible roller 46 is disposed in a lower position with respect to the conveyer roller 26. The first intermediate reversible roller 46 is driven by a driving force from a drive source M3. Rotation of the first intermediate reversible roller 46 is switchable between two (2) rotating directions: a direction to convey the sheet P upward, and an opposite direction to convey the sheet P downward. The rotating direction for the first intermediate reversible roller 46 to convey the sheet P upward is the third rotating direction being the normal direction, and the rotating direction for the first intermediate reversible roller 46 to convey the sheet P downward is the fourth rotating direction being the reverse direction. The first intermediate reversible roller 46 may rotate in the third rotating direction to convey the sheet P upward at a first predetermined circumferential speed and in the fourth rotating direction at a second predetermined circumferential speed.

The second intermediate reversible roller 47 is disposed in a frontward position with respect to the first intermediate reversible roller 46 and is attached to a lower end on the rearward face of the second frame 42. The second intermediate reversible roller 47 is disposed in a lower position with respect to the conveyer roller 26 and is arranged to contact the first intermediate reversible roller 46. The second intermediate reversible roller 47 is disposed in an upwardly displaced position from the first intermediate reversible roller 46. Therefore, a tangent L1 (see FIG. 4) at a nipping section between the first intermediate reversible roller 46 and the second intermediate reversible roller 47 in a view along the widthwise direction inclines to extend upward to be farther from the sheet exit 2B or downward to be closer to the sheet exit 2B. The second intermediate reversible roller 47 may be rotated to accompany rotation of the first intermediate reversible roller 46.

The rear cover 23 is disposed in a rearward position with respect to the second frame 42 to be spaced apart from the second frame 42. The rear cover 43 extends in the vertical direction and includes an upper part which curves frontward. The rear cover 43 in conjunction with the second frame 42 forms the reversing path 41B. The rear cover 43 includes a fourth guiding rib 43A and the reversible roller 48.

The fourth guiding rib 43A is formed on a frontward face of the rear cover 43 to protrude frontward. The fourth guiding rib 43A extends in the vertical direction and is formed to curve rearward in a vertically central range thereof.

The reversible roller 48 is attached to a frontend part of the rear cover 43 in an upper position with respect to the opposing roller 45. The reversible roller 48 is disposed in a rearward position with respect to the exit roller 24 and is arranged to contact the opposing roller 45. Therefore, the reversible roller 48 is disposed in a position spaced apart in the front-rear direction farther than the exit roller 24 from the sheet-outlet tray 2A. The reversible roller 48 is driven to rotate by a driving force from a drive source M4. Rotation of the reversible roller 48 is switchable between two (2) rotating directions: a direction to convey the sheet P frontward, and an opposite direction to convey the sheet P rearward. The rotating direction for the reversible roller 48 to convey the sheet P frontward is the first rotating direction being the normal direction, and the rotating direction for the reversible roller 48 to convey the sheet P rearward is the second rotating direction being the reverse direction. The reversible roller 48 may rotate in the first rotating direction to convey the sheet P toward the opening 2C at a first predetermined circumferential speed and in the second rotating direction at a second circumferential speed. The first predetermined circumferential speed for the reversible roller 48 and the third predetermined circumferential speed for the first intermediate reversible roller 46 are substantially equal, and the second predetermined circumferential speed for the reversible roller 48 and the fourth predetermined circumferential speed for the first intermediate reversible roller 48 are substantially equal.

A distance D1 between the reversible roller 48 and the first intermediate roller 46 along the curve of the third guiding rib 42B in the reversible path 41B is longer than a distance D2 between the exit roller 24 and the conveyer roller 26 along the curve of the first guiding rib 21A in the sheet-exit path 41A.

2-3. Sheet Conveyance in a Double-Face Printing Operation 2-3-1. Sheet Conveyance to the Duplex Path A flow of behaviors to convey a sheet P1 to the duplex path 12A will be described below with reference to FIGS. 4-7.

When the sheet P1 is conveyed to the duplex path 12A, as shown in FIG. 4, the flap 44 is placed in the first guiding position.

The sheet P1 with an image printed on one side, e.g., a first side, thereof is conveyed through the contacting position between the heat roller 10A and the pressure roller 10B to enter a lower section in the reversing path 41B. In the following description, with regard to a direction for the sheet P1 to be conveyed through the contacting position, a downstream end area and an upstream end area in the sheet P will be referred to as a first end E1 and a second end E2, respectively. The first intermediate reversible roller 46 and the reversible roller 48 may start rotating at the first and third predetermined circumferential speed in the normal direction at a same timing as rotation of the heat roller 10A.

As the sheet P1 proceeds, the first end E1 of the sheet P1 contacts the contact part 30B of the sensor 30, and the sensor 30 is rotated by the sheet P1 from the non-detecting position to the detecting position.

After the first end E1 of the sheet P1 exits the nipping section between the first intermediate reversible roller 46 and the second intermediate reversible roller 47, the sheet P1 is conveyed upper-rearward by the first intermediate reversible roller 46 rotating in the normal direction and accompanying rotation of the second intermediate reversible roller 47.

The first end E1 of the sheet P1 is guided by the fourth guiding rib 43A and enters a position between the reversible roller 48 and the opposing roller 45. As the sheet P is conveyed frontward by the reversible roller 48 rotating in the normal direction and accompanying rotation of the opposing roller 45, the sheet P1 is bowed to curve upper-frontward along the reversing path 41B.

Figure 5:
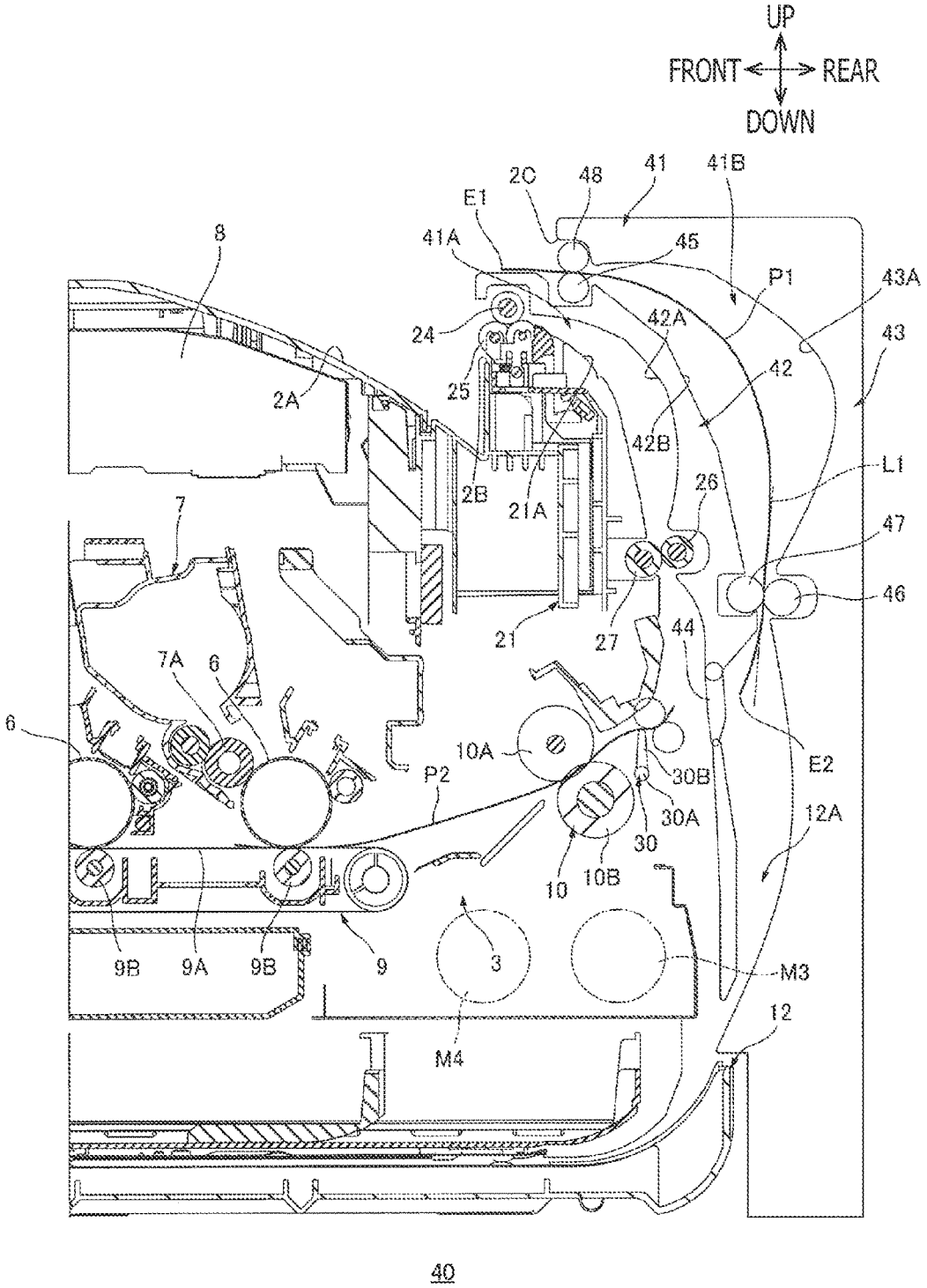
FIG. 5 is a cross-sectional view of the sheet-exit unit the image forming apparatus, with the first sheet being guided to the first path the flap being in a second guiding position, according to the second exemplary embodiment of the present disclosure.

Thereafter, the reversible roller 48 is slowed to a lower circumferential speed than the first predetermined circumferential speed. In the present embodiment, the reversible roller 48 is stopped with the first end E1 of the sheet P1 nipped between the reversible roller 48 and the opposing roller 45, as shown in FIG. 5. The first end E1 of the sheet P1 may be in a position with regard to the front-rear direction between the front end of the second frame 42 and the opening 2C.

Figure 6:
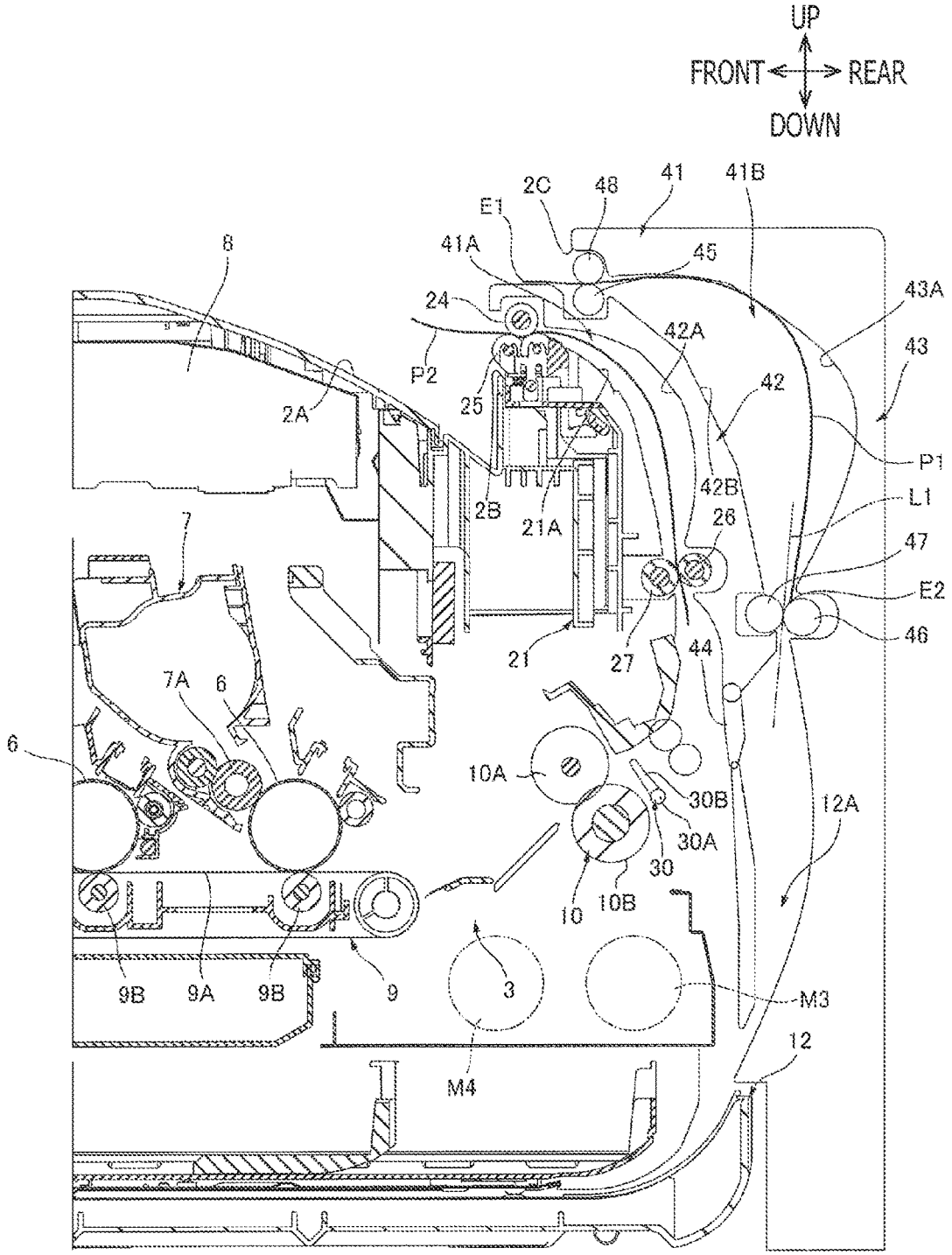
FIG. 6 is a cross-sectional view of the sheet-exit unit in the image forming apparatus, with the first sheet being accommodated in the first path and a second sheet being conveyed in a second path, according to the second exemplary embodiment of the present disclosure.

Thereafter, with the reversible roller 48 being stopped, the first intermediate reversible roller 46 is rotated in the normal direction at the third predetermined circumferential speed. With the first end E1 maintained nipped by the reversible roller 48 and the opposing roller 45, the second end E2 of the sheet P is conveyed upward by the normal rotation of the first intermediate reversible roller 46 and the accompanying rotation of the opposing roller 45. Therefore, the sheet P1 is relaxed to curve rearward and accommodated in the reversing path 41B, as shown in FIG. 6.

When the second end E2 of the sheet P1 exits the position between the first intermediate reversible roller 46 and the second intermediate reversible roller 47, with the first end E1 of the sheet P being nipped by the first intermediate reversible roller 46 and the second intermediate reversible roller 47, the first intermediate reversible roller 46 is rotated in the reverse direction.

After the first intermediate reversing roller 46 starts rotating in the reverse direction, with the reversible roller 48 being stopped, the first intermediate reversible roller 46 rotates in the reverse direction at the fourth predetermined circumferential speed. The second end E2 of the sheet P1 may reenter the position between the first intermediate reversible roller 46 and the second intermediate reversible roller 47 due to the effect of gravity. Thereby, the second end E2 of the sheet is conveyed downward, and the relaxed curve of the sheet P1 is removed.

Thereafter, the reversible roller 48 starts rotating in the reverse direction at the second predetermined circumferential speed. The sheet P1 is conveyed downward by the reverse rotation of the first intermediate reversible roller 46 and the reverse rotation of the reversible roller 48.

Figure 7:
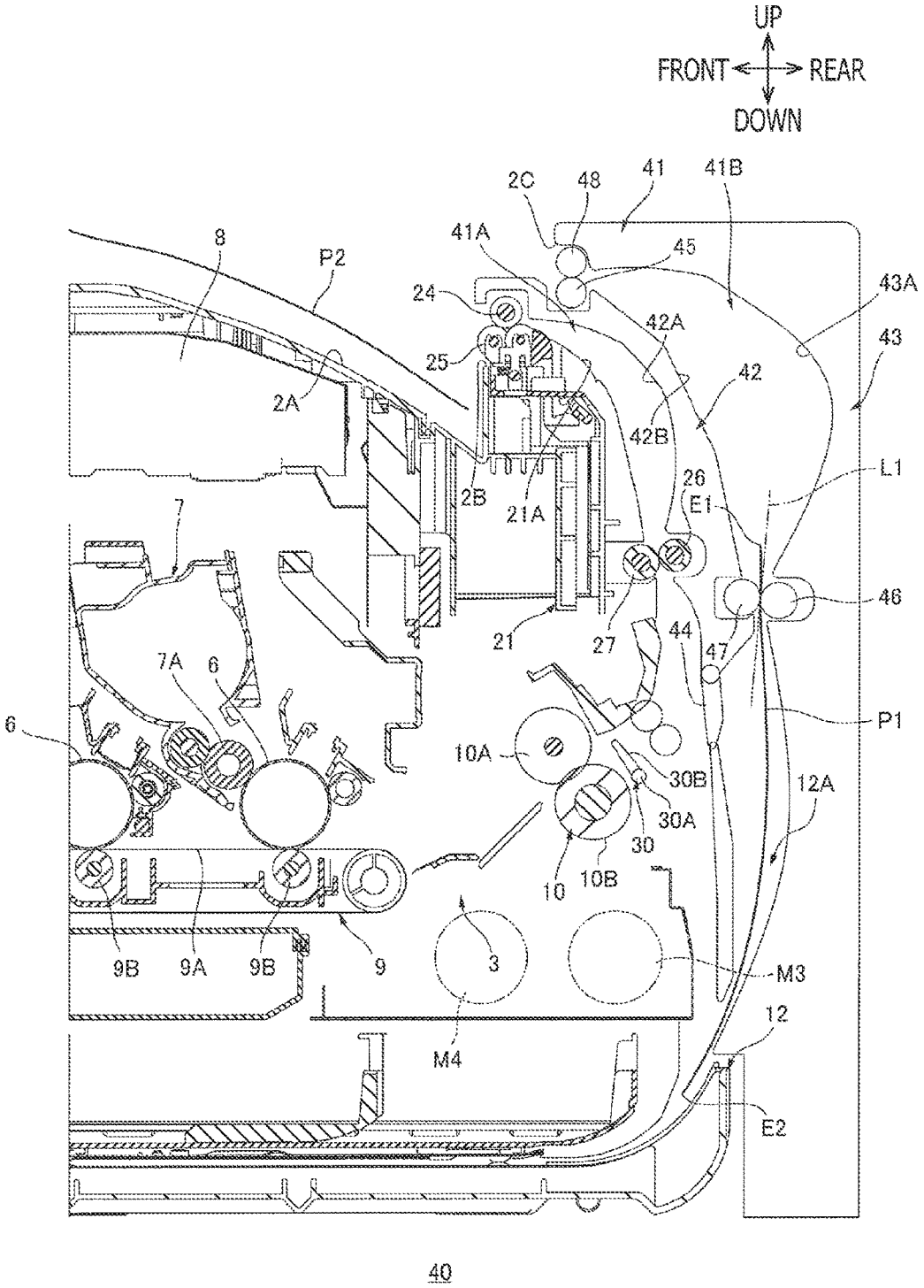
FIG. 7 is a cross-sectional view of the sheet-exit unit in the image forming apparatus, with the first sheet being conveyed in a duplex path and the second sheet being discharged at a sheet-outlet tray, according to the second exemplary embodiment of the present disclosure.

Thereafter, the sheet P1 is conveyed by the reverse rotation of the first intermediate reversible roller 46 to pass by the fixing device 10 downward, as shown in FIG. 7, and, with the second end E2 now being a leading end, enters the duplex path 12A.

The sheet P1 entering the duplex path 12A is conveyed through the duplex path 12A to the midst position in the feeding path 4A (see FIG. 1).

2-3-2. Discharging the Double-Face Printed Sheet

Next, a flow of behaviors to discharge a sheet P2 at the sheet-outlet tray 2A will be described below with reference to FIGS. 5-7.

After the image is formed on the other side, e.g., a second side, of the sheet P2, the sheet P2 with the images on both sides thereof may be conveyed to the sheet-outlet tray 2A. When the sheet P2 is discharged at the sheet-outlet tray 2A, the flap 44 is placed in the second guiding position, as shown in FIG. 5.

The sheet P2 conveyed through the contacting position between the heat roller 10A and the pressure roller 10B is guided by the flap 44 and enters the lower section of the sheet-exit path 41A.

In the meantime, there may be a case that the sheet P1 with the image printed on the first side is in the reversing path 41B. For example, when double-face printing is performed on a plurality of sheets P sequentially, a preceding sheet P, e.g., the sheet P2 in FIG. 5, with the images printed on both sides thereof, may be ejected while a succeeding sheet P, e.g., the sheet P1 in FIG. 5, with the image printed on the first side thereof, is being inverted. In this regard, as shown in FIG. 6, the sheet P2 may be conveyed through the sheet-exit path 41A toward the sheet-outlet tray 2A.

Meanwhile, the first end E1 of the sheet P1 with the image printed on the first side thereof may be held by the reversible roller 48 and the opposing roller 45, which is at a rearward position with respect to the frontend part of the second frame 42. Therefore, the sheet P1 in the reversing path 41B may be prevented from being colliding with the sheet P2 conveyed in the sheet-exit path 41A.

Thereafter, as shown in FIG. 7, the sheet P2 may be discharged in the sheet-outlet tray 2A. Meanwhile, the sheet P1 may be conveyed to the duplex path 12A according to the flow described above.

2-4. Effects by the Second Exemplary Configuration

The image forming apparatus 40 includes the sheet exit 2B, which is formed in the lower position with respect to the opening 2C to open toward the same side as the opening 2C, and the sheet-exit path 41A, which may guide the sheet P2 exiting the image forming unit 3 to the sheet exit 2B. The image forming apparatus 40 further includes the exit roller 24, which is disposed in the sheet-exit path 41A.

Thus, the image forming apparatus 40 has the reversing path 41B, in which the sheet P1 may be reversed; the sheet-exit path 41A, and the exit roller 24, which are separate from the reversing roller 48 and the first intermediate reversing roller 46, respectively. Therefore, as shown in FIG. 6, while the sheet P1 with the image printed on one side thereof is drawn in the reversing path 41B, the sheet P2 with the images printed on both sides thereof may be discharged by the exit roller 24 without being interfered with by the sheet P1.

According to the image forming apparatus 40 described above, further, as shown in FIG. 4, the reversible roller 48 is located at the position with regard to the front-rear direction spaced apart farther than the exit roller 24 from the sheet-outlet tray 2A. Therefore, when the sheet P2 is discharged to the sheet-outlet tray 2A, as shown in FIG. 6, while the sheet P1 is held by the reversible roller 48 at the position spaced apart farther than the exit roller 24 from the sheet-outlet tray 2A, the sheet P2 may be conveyed by the exit roller 24. Accordingly, collision between the sheet P2 to be conveyed to the sheet-outlet tray 2A and the sheet P1 to be held by the reversible roller 48 may be prevented.

According to the image forming apparatus 40 described above, further, as shown in FIG. 4, the image forming apparatus 40 has the flap 44, which is movable between the first guiding position (see FIG. 4), in which the sheet P1 may be guided to the reversing path 41B, and the second guiding position (see FIG. 5), in which the sheet P2 may be guided to the sheet-exit path 41A. Therefore, with the flap 44 placed in the first guiding position, as shown in FIG. 4, the sheet P1 may be securely guided to the reversing path 41B.

Further, with the flap 44 placed in the second guiding position, as shown in FIG. 6, the sheet P2 may be securely guided to the sheet-exit path 41A.

According to the image forming apparatus 40 described above, further, as shown in FIG. 4, the distance D1 between the reversible roller 48 and the first intermediate roller 46 along the curve of the third guiding rib 42B in the reversible path 41B is longer than the distance D2 between the exit roller 24 and the conveyer roller 26 along the curve of the first guiding rib 21A in the sheet-exit path 41A. Therefore, a substantial volume for the sheet P1 to be accommodated in the reversing path 41B may be reserved. Therefore, the sheet P1 may be drawn in the range between the reversible roller 48 and the first intermediate reversible roller 46 effectively without being excessively deformed.

According to the image forming apparatus 40 described above, further, as shown in FIG. 5, the tangent L1 at the nipping section between the first intermediate reversible roller 46 and the second intermediate reversible roller 47 viewed along the widthwise direction inclines to be farther from the sheet exit 2B at an upper position and closer to the sheet exit 2B at a lower position. Therefore, the sheet P1 conveyed through the position between the first intermediate reversible roller 46 and the second intermediate reversible roller 47 may be effectively conveyed to be farther from the opening 2C as the sheet P1 proceeds upward and may be curved thereafter along the reversing path 41B. Accordingly, the sheet P1 may be bowed effectively along the reversing path 41B.

3. More Examples

Although examples of the present disclosure has been described, those skilled in the art will appreciate that there are numerous variations and permutations of the image forming apparatus that fall within the spirit and scope of the present disclosure as set forth in the appended claims. It is to be understood that the subject matter defined in the appended claims is not necessarily limited to the specific features or act described above. Rather, the specific features and acts described above are disclosed as example forms of implementing the claims.

For example, as mentioned above in the first embodiment, while the sheet P is being reversed, the exit roller 24 may not necessarily be stopped while the conveyer roller 26 is rotated in the normal direction as long as the circumferential speed of the exit roller 24 is slower than the circumferential speed of the conveyer roller 26. In the second embodiment, while the sheet P1 is being reversed, the reversible roller 48 may not necessarily be stopped while the first intermediate reversible roller 46 is rotated in the normal direction as long as the circumferential speed of the reversible roller 48 is slower than the circumferential speed of the first intermediate reversible roller 46.

In other words, with regard to the first embodiment, the exit roller 24 may be rotated in the normal direction at a lower circumferential speed than the first predetermined circumferential speed while the conveyer roller 26 is rotated in the normal direction at the third predetermined circumferential speed. With regard to the second embodiment, the reversible roller 48 may be rotated in the normal direction at a lower circumferential speed than the first predetermined circumferential speed while the first intermediate reversible roller 46 is rotated in the normal direction at the third predetermined circumferential speed. Thus, the effects that may be achieved in the first and second embodiments described above may be similarly achieved.

What is claimed is:

1. An image forming apparatus, comprising:

a housing formed to have a first opening;

an image forming unit;

a first path formed to guide a recording medium conveyed through the image forming unit toward the first opening;

a reversible roller disposed in the first path, the reversible roller being configured to rotate in a first rotating direction, in which the recording medium is conveyed toward the first opening, and a second rotating direction opposite from the first rotating direction, a circumferential speed of the reversible roller ranging between a predetermined circumferential speed and none; and an intermediate reversible roller disposed between the image forming unit and the reversible roller in the first path, the reversible roller being configured to rotate in a third rotating direction, in which the recording medium is conveyed from the image forming unit toward the reversible roller, and a fourth rotating direction opposite from the third rotating direction, wherein the circumferential speed of the reversible roller in the first rotating direction is reduced to be lower than the predetermined circumferential speed while the intermediate reversible roller is rotating in the third rotating direction.

2. The image forming apparatus according to claim 1, wherein the circumferential speed of the reversible roller in the first rotating direction is reduced to none while the intermediate reversible roller is rotating in the third rotating direction.

3. The image forming apparatus according to claim 1, wherein the image forming unit comprises a fixing device configured to fix a toner image formed on the recording medium thereat; and wherein the reversible roller is configured to rotate in the first rotating direction when the intermediate reversible roller rotates in the third rotating direction to convey the recording medium toward the reversible roller and to start rotating in the second rotating direction after the recording medium conveyed through the image forming unit exits the intermediate reversible roller.

4. The image forming apparatus according to claim 1, wherein the reversible roller is configured to start rotating in the second rotating direction after the intermediate reversible roller rotated in the third rotating direction starts rotating in the fourth rotating direction.

5. The image forming apparatus according to claim 1, wherein the housing is formed to have a second opening, the second opening being formed in a lower position than the first opening to open toward a same side as the first opening, and a second path formed to guide the recording medium exiting the image forming unit; and wherein the image forming apparatus further comprises an exit roller disposed in the second path and configured to convey the recording medium from the image forming unit toward the second opening.

6. The image forming apparatus according to claim 5, wherein the first path and the second path are formed alongside each other in a direction orthogonal to a vertical direction;

wherein the image forming apparatus further comprises an outlet tray disposed on an opposite side from the exit roller across the second opening in the orthogonal direction; and wherein the reversible roller is spaced apart farther than the exit roller from the outlet tray in the orthogonal direction.

7. The image forming apparatus according to claim 5, further comprising:

a switching member configured to move between a first guiding position, in which the recording medium is guided to the first path, and a second guiding position, in which the recording medium is guided to the second path.

8. The image forming apparatus according to claim 5, further comprising:

an intermediate exit roller disposed between the exit roller and the image forming unit in the second path, the intermediate exit roller being configured to convey the recording medium from the image forming unit toward the exit roller, wherein a distance between the reversible roller and the intermediate reversible roller along the first path is longer than a distance between the exit roller and the intermediate exit roller along the second path.

9. The image forming apparatus according to claim 1, further comprising:

an outlet tray disposed above the image forming unit, wherein the first path is formed to extend upward from the image forming unit and curve toward the outlet tray.

10. The image forming apparatus according to claim 1, wherein the first path includes a first guiding part and a second guiding part, the second guiding part being disposed in a position closer than the first guiding part to the image forming unit and arranged to face the first guiding part; and wherein a curvature radius in the first guiding part is smaller than a curvature radius in the second guiding part in a view along a direction of a rotation axis of the reversible roller.

11. The image forming apparatus according to claim 10, wherein the intermediate reversible roller comprises a first intermediate reversible roller and a second intermediate reversible roller arranged to face the first intermediate reversible roller, the first intermediate reversible roller and the second intermediate reversible roller forming a nipping section to nip the recording medium; and wherein a tangent at the nipping section in the view along the direction of the rotation axis of the reversible roller inclines to extend upward to be farther from the first opening.

12. The image forming apparatus according to claim 1, further comprising:

a sensor disposed between the image forming unit and the intermediate reversible roller in the first path, the sensor being configured to detect the recording medium, wherein behavior of the reversible roller is selected among rotation in the first rotating direction, rotation in the second rotating direction, and stoppage, depending on detection of the recording medium by the sensor.

13. The image forming apparatus according to claim 12, wherein the reversible roller rotating in the first rotating direction is stopped after elapse of a first predetermined length of time from detection of the recording medium by the sensor, and after elapse of a second predetermined length of time from stoppage of the reversible roller, the reversible roller is rotated in the second rotating direction; and wherein the intermediate reversible roller rotated in the third rotating direction is starts rotating in the fourth rotating direction after elapse of a third predetermined length of time from the detection of the recording medium by the sensor.

14. The image forming apparatus according to claim 1, wherein the reversible roller rotated in the first rotating direction starts rotating in the second rotating direction without conveying the recording medium beyond the reversible roller.

15. The image forming apparatus according to claim 1, further comprising:

a first drive source configured to cause rotation of the reversible roller in the first rotating direction and in the second rotating direction and control the circumferential speed of the reversible roller to be driven between the predetermined circumferential speed and none; and a second drive source configured to cause the intermediate reversible roller to rotate in the third rotating direction and in the fourth rotating direction, wherein the first drive source controls the circumferential speed of the reversible roller in the first rotating direction to be reduced lower than the predetermined circumferential speed while the intermediate reversible roller is rotating in the third rotating direction.

* * * * *